US005219008A

United States Patent [19]

Shannon

[11] Patent Number: 5,219,008

[45] Date of Patent: Jun. 15, 1993

[54] ICE DISPENSER FOR SOFT DRINK SYSTEM

[75] Inventor: Joseph W. Shannon, Kent, Ohio

[73] Assignee: ABC/Techcorp, Akron, Ohio

[21] Appl. No.: 684,761

[22] Filed: Apr. 15, 1991

[51] Int. Cl.[5] ..... B65B 1/36

[52] U.S. Cl. ..... 141/83; 141/94; 222/63; 73/861.41; 73/865.5

[58] Field of Search ..... 222/64, 52, 59, 14, 222/55, 56, 63; 141/94, 95, 83; 73/861.41, 865.5; 377/6

[56] References Cited

U.S. PATENT DOCUMENTS

| | | | |
|---|---|---|---|
| 2,607,520 | 8/1952 | Bateman | 222/64 |
| 3,638,392 | 2/1972 | Welker, Jr. et al. | 222/64 |
| 3,683,681 | 8/1972 | Taylor | 73/159 |
| 4,417,671 | 11/1983 | Kawasaki et al. | 222/56 |
| 4,744,381 | 3/1988 | Farmer et al. | 141/94 |
| 4,917,155 | 4/1990 | Koblasz et al. | 141/95 |
| 4,944,336 | 7/1990 | Stembridge et al. | 141/95 |
| 4,982,412 | 1/1991 | Gross | 377/6 |
| 5,047,962 | 9/1991 | Cornish | 377/6 |

*Primary Examiner*—Andres Kashnikow
*Assistant Examiner*—Lesley D. Morris
*Attorney, Agent, or Firm*—Renner, Kenner, Greive, Bobak, Taylor, & Weber

[57] ABSTRACT

An ice dispensing system for a soft drink dispenser employs a microphone adjacent a cup into which ice and soft drink are to be dispensed. The microphone senses sounds made by ice pieces dropping into the cup and converts the sounds to electrical signals. These electrical signals, characteristic of the masses of the pieces of ice dropping into the cup, are tallied during the dispensing cycle and the dispensing cycle is then terminated when the tally reaches a predetermined level, indicating that an appropriate compliment of ice has been dispensed.

6 Claims, 1 Drawing Sheet

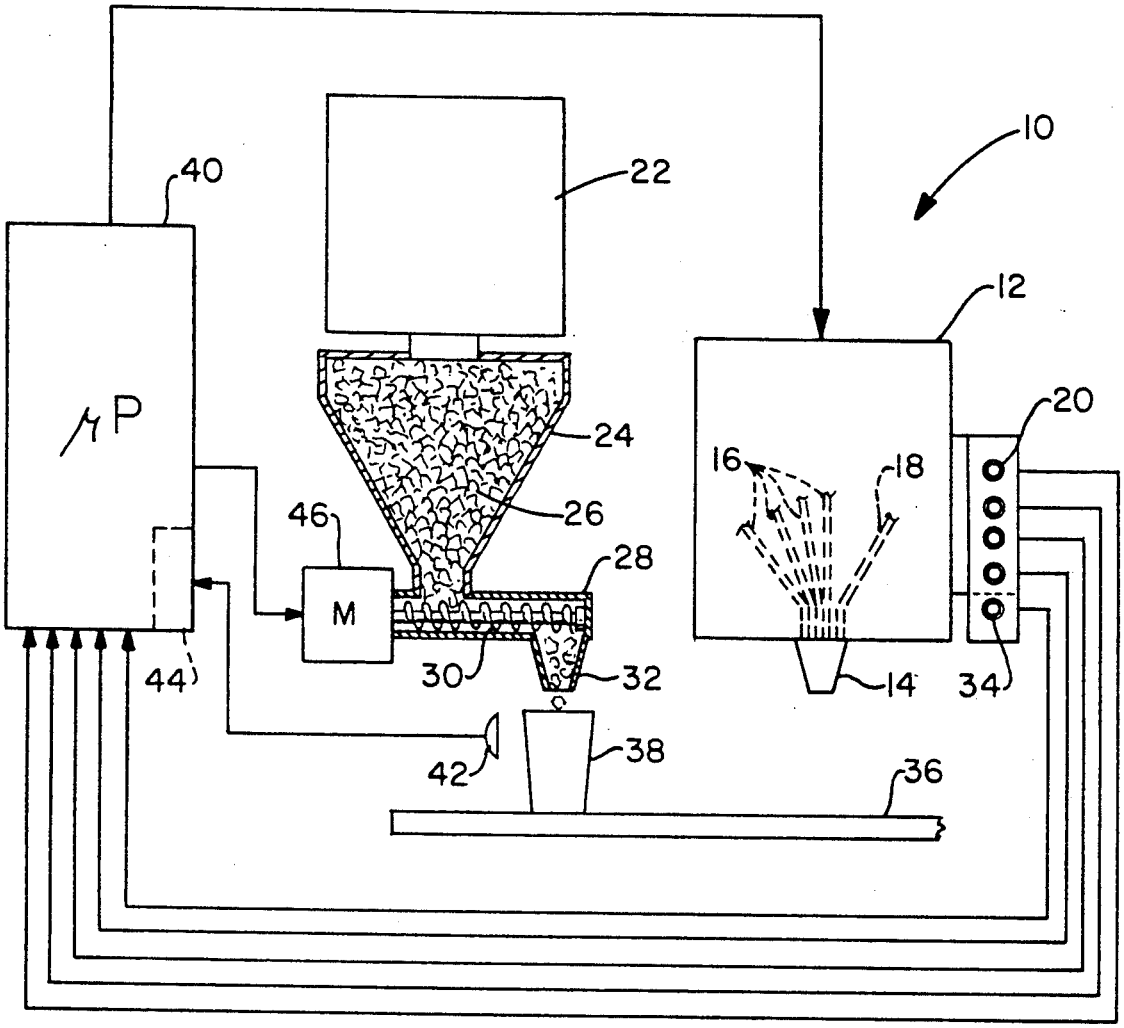
FIG.-1
FIG.-2
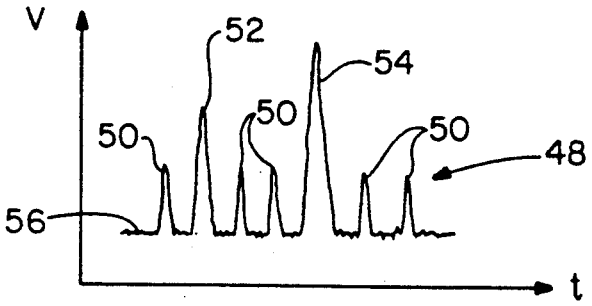

ICE DISPENSER FOR SOFT DRINK SYSTEM

TECHNICAL FIELD

The invention herein resides in the art of soft drink dispensers and, more particularly, to an ice dispenser adapted for implementation therewith. Specifically, the invention relates to an ice dispenser for a soft drink system in which the actual dispensing of pieces of ice is monitored and the dispensing cycle is controlled to assure an appropriate volume of ice is dispensed into a receptacle prior to dispensing of the soft drink.

BACKGROUND ART

Soft drink dispensers have become increasingly automated. Such systems are now capable of dispensing full measures of soft drink by appropriately combining syrup and soda in a cup or other appropriate receptacle having a quantity of ice therein. Such dispensing is achieved rapidly, and in such a manner as to minimize foam and prevent overflow, while assuring a full measure of soft drink within the receptacle.

Presently, the most inefficient portion of soft drink dispensers appears to be the ice dispensing mechanism. The art has passed from ice bins requiring manual retrieval of ice to ice bins which incorporate motor-driven augers for dispensing ice from the bin into the soft drink cup. Some systems require that an operator controls the actuation and termination of the ice dispensing cycle by control of an actuation switch or button. However, such systems preclude the operator from performing other functions during the ice dispensing cycle. More automated systems allow the operator to engage an ice dispensing cycle by simply actuating a switch which causes the motor and associated auger to run for a fixed period of time. Such systems assume that the amount of ice dispensed in such time period will be of a predetermined and consistent quantity. However, because of the physical structure of ice cubes or discs, the ice often bridges the auger, allowing voids to pass therealong during the dispensing cycle. Conversely, ice cubes or discs often freeze together as a conglomeration. In such event, the amount of ice dispensed during a dispensing cycle is often greater than when individual cubes or discs are maintained within the bin and so dispensed. Indeed, it has been found that for any given time period, the amount of ice dispensed with present ice machines can vary over a extremely broad range.

It is most desirable that the quantity of ice in a soft drink cup be rather consistent from drink to drink. If too little ice is dispensed, the ice may all melt, failing to keep the drink cold. At the other end of the spectrum, if too much ice is dispensed, the customer may feel cheated on hid purchase, having received less than a full measure of soft drink in return for a much larger portion of ice.

There is presently a need in the art for an ice dispensing system which constantly monitors the actual dispensing of ice pieces, terminating the ice dispensing cycle when a preset volume of ice has been dispensed.

DISCLOSURE OF INVENTION

In light of the foregoing, it is a first aspect of the invention to provide an ice dispenser for a soft drink system in which the actual volume of ice dispensed is measured.

Another aspect of the invention is to provide an ice dispenser for a soft drink system in which the dispensing of ice is monitored in such a manner as to effectively total the volume of ice dispensed.

Yet an additional aspect of the invention is to provide an ice dispenser for a soft drink system in which the sounds of ice pieces being received within a cup or receptacle are sensed and converted into signals corresponding to ice mass, such signals being summed to account for a total volume of ice dispensed during the cycle.

Yet an additional aspect of the invention is the provision of an ice dispenser for a soft drink system which is accurate and reliable in operation, easily implemented with present automatic soft drink dispensers, and cost effective in manufacture and implementation.

The foregoing and other aspects of the invention which will become apparent as the detailed description proceeds are achieved by an ice system for a soft drink dispenser, comprising: an ice bin; first means for dispensing pieces of ice from said bin into a receptacle; and second means for measuring an amount of ice received by said receptacle and terminating said dispensing when said amount exceeds a set level.

Further aspects of the invention are attained by an ice dispenser for a soft drink system, comprising: an ice bin containing pieces of ice; first means for dispensing said pieces of ice into a receptacle; and second means for sensing sounds made by said pieces of ice dispensed into said receptacle and determining a volume of ice so dispensed as a function of said sounds.

DESCRIPTION OF DRAWING

For a complete understanding of the objects, techniques and structure of the invention reference should be made to the following detailed description and accompanying drawing wherein:

FIG. 1 is a schematic diagram of a soft drink system according to the invention, showing, in partial cross section, the ice dispensing system associated therewith; and FIG. 2 is a graph of the sounds emanating from the cup or receptacle receiving ice from the system according to the invention.

BEST MODE FOR CARRYING OUT THE INVENTION

Referring now to the drawing and more particularly FIG. 1, it can be seen that a soft drink dispenser according to the invention is designated generally by the numeral 10. As shown, the soft drink dispenser 10 will typically include a syrup and soda system 12 which, being only of general interest herein, may be of any suitable nature. Those skilled in the art will understand that the syrup and soda system 12 will typically comprise sources of syrup communicating with the dispensing head 14 through syrup conduits 16 by means of appropriate mechanical or pressure pumps. In like manner, the system 12 will also include a source of soda which, in the preferred embodiment, will communicate with the dispensing head 14 through a soda conduit 18 under an appropriate pressure head. Present systems actuate and terminate dispensing cycles by means of solenoid valves or the like, all of which is again of general interest to the present invention, and well understood by those skilled in the art.

A bank of selector buttons or pour switches 20 is also provided with the soft drink dispenser 10 and particularly in association with the syrup and soda system 12.

Associated with each of the buttons or switches 20 is a particular brand and/or volume of soft drink to be dispensed. In the automated systems presently available, simple actuation of one of the switches 20 will cause an appropriate volume of soft drink to be dispensed.

Also included as part and parcel of the soft drink system 10 is an ice making device 22. Those skilled in the art will understand that the device 22 includes refrigerated receptacles for receiving water and converting the same to ice. An ice bin 24 is maintained beneath the device 22 and is preferably funnel-shaped, as shown. The ice bin 24 is adapted to receive the ice cubes, discs, or the like produced by the ice-making device 22. At the bottom of the ice bin 24 is an ice passage 28 which is defined by a housing receiving an auger 30. Near one end of the ice passage 28 is a dispensing chute 32, again funnel shaped to receive ice from the passage 28 as urged along by the auger 30.

An ice dispensing switch 34 is provided as part and parcel of the system 10 and is adapted to initiate an ice dispensing cycle. As will become apparent below, a cup 38 is received upon a support shelf 36 beneath the dispensing chute 32 such that commencement of an ice dispensing cycle by means of actuation of the switch 34 and rotation of the auger 30 causes ice pieces 26 to pass from the bin 24, through the passage 28, out of the chute 32, and into the cup or receptacle 38.

As will be readily appreciated by those skilled in the art, an appropriate control unit 40, such as a dedicated microprocessor or the like, will typically be provided in association with the soft drink dispenser 10. As shown, the microprocessor 40 receives signals from the selector or pour switches 20 and the ice dispensing switch 34 to respectively dispense the syrup and soda comprising a soft drink, and the ice needed therefore. It is presently well known in the art that the actuation of the switches 20, sensed by the control unit 40, causes the appropriate actuation of pumps and/or solenoid valves to allow the dispensing of the requisite syrup and soda. The control of the ice dispensing feature is presented in more detail below.

Positioned beneath the ice dispensing chute 32 and in juxtaposition to the cup or receptacle 38 is a microphone or other noise sensor 42. The microphone 42 is adapted to receive audible signals as ice is received in the cup 38 and to pass such signals to the control unit 40. Within the control unit 40, an ice dispensing monitoring circuit 44 receives the electrical signals from the microphone 42 which correspond to the sound of pieces of ice passing from the chute 32 into the cup 38. The monitoring circuit 44 determines when an appropriate amount of ice has been dispensed into the cup 38 and terminates the ice dispensing cycle when the volume of ice so dispensed is determined to have reached a predetermined level.

The actual control of the dispensing of ice is achieved by means of actuation and termination of the operation of a motor 46 having its output shaft connected to the auger 30 for driving the same within the passage 28. It will be readily appreciated by those skilled in the art that actuation of the ice dispensing switch 34 by an operator causes the microprocessor or control unit 40 to actuate the motor 46, turning the auger 30 and causing the ice pieces such as cubes or discs to be dispensed from the bin 24, through the chute 32, and into the cup 38. With the microphone 42 receiving the sounds of the ice pieces dropping into the cup 38 and upon each other, the monitoring circuit 44 can then tally the total volume of ice being dispensed from the time the switch 34 is actuated. When such tally reaches a predetermined level, the monitoring circuit 44 simply advises the control unit 40 to terminate operation of the motor 46, terminating the dispensing of ice pieces. With reference to FIG. 2, it can be seen that the sounds monitored by the microphone 42 and the resulting electrical signals are a function of the volume of ice pieces dropping from the chute 32 and into the receptacle 38. The signal pattern of a typical dispensing cycle is designated generally by the numeral 48. As shown, signal 48 comprises a low level base signal having a plurality of spikes 50, 52, 54 riding thereon. The base level 56 would typically constitute an ambient noise such as from the motor 46 and auger 30 which could be readily filtered by means of an appropriate noise filter devised as part and parcel of the monitoring circuit 44. The spikes 50 correspond to the electrical signals generated as a consequence of the sound monitored by the microphone 42 when a single ice cube or disc falls into the cup 38, either upon the bottom of the cup or upon another piece of ice. The spike 52 is of amplitude and duration indicative of two pieces of ice, either discs or cubes, stuck together at the time they are received within the cup 38. Similarly, the spike 54, having an even greater amplitude and duration, is indicative of the sound generated by a chunk of ice comprising three cubes or discs frozen together at the time they hit within the container 38. Obviously, those skilled in the art will readily recognize that appropriate filtering, scaling, and buffering of the signal 48 may be undertaken to achieve the desired data enhancement characteristics. It will be appreciated that the characteristic sounds of various sizes of ice pieces or chunks may vary as a function of the volume of ice present in the cup 38. Such signal variations may be readily anticipated and accommodated.

It is contemplated that the ice dispensing monitoring circuit 44 may be of various natures. Those skilled in the art should now recognize that, by adding the various spikes 50, 52, 54 of the signal 48, a resultant signal can be obtained which is indicative of the number of pieces of ice actually dispensed during the dispensing cycle. Accordingly, the actual mass or volume of ice dispensed can similarly be determined. Accordingly, the monitoring circuit 44 can, in a first instance, comprise an integrator receiving the signal 48 and integrating the spikes 50, 52, 54 until a predetermined level is reached. This level would, of course, correspond to a preset volume or mass of ice at which ice dispensing should terminate.

It is further contemplated that the monitoring circuit 44 could simply comprise a peak-sample circuit and an associated integrator. In such a situation, the amplitudes of each of the spikes 50, 52, 54 would be measured and summed with all other spikes until a preset level was reached, at which time the dispensing cycle would terminate.

Finally, it is contemplated that the monitoring circuit 44 could comprise an analog-to-digital (A/D) converter receiving the signal 48 and digitizing the same. The resultant digital output signals, appropriately scaled and weighted, would then be fed to a digital counter where the counting of the signal spikes 50, 52, 54 would be undertaken. With each of the spikes 50, 52, 54 having a different scale value or weighted value, the counter would then maintain an ongoing count indicative of the mass or volume of ice dispensed.

Irrespective of the specific type of measurement circuitry employed by the monitoring circuit 44, it will be appreciated that the basic concept of the invention is to analyze the sounds of ice received within the cup 38 and to attribute various masses of ice to the different sounds. An appropriate summing circuit, integrator, or counter may then be employed to keep a running tally of the ice dispensed during the dispensing cycle to terminate the dispensing cycle when a preset volume of ice has been received within the cup. Actuation of the dispensing cycle is manually undertaken through the switch 34 and control unit 40, while termination of the dispensing cycle is undertaken by means of the microphone 42, monitoring circuit 44, and control unit 40.

Thus it can be seen that the objects of the invention have been satisfied by the structure presented above. While in accordance with the patent statutes only the best mode and preferred embodiments of the invention have been presented and described in detail, it is to be understood that the invention is not limited thereto or thereby. Accordingly, for an appreciation of the true scope and breadth of the invention reference should be made to the following claims.

What is claimed is:

1. An ice system for a soft drink dispenser, comprising:

an ice bin;

first means for dispensing pieces of ice from said bin into a receptacle; and second means for measuring an amount of ice received by said receptacle and terminating said dispensing when said amount exceeds a set level, wherein said second means counts a number of said pieces of ice dispensed into said receptacle by sensing sounds made by said pieces of ice as they are received by said receptacle and correlates said sounds to particular volumes of said pieces of ice, said second means comprising a microphone in juxtaposition to said receptacle, generating electrical signals corresponding to said sounds, and an integrator connected to said microphone for integrating said electrical signals.

2. The ice system according to claim 1, wherein said first means comprises an auger in communication with said ice bin and driven by a motor.

3. An ice dispenser for a soft drink system, comprising:

an ice bin containing pieces of ice;

first means for dispensing said pieces of ice into a receptacle; and second means for sensing sounds made by said pieces of ice dispensed into said receptacle, converting said sounds into electrical signals, and determining a volume of ice so dispensed as a function of said sounds, said second means bomprising an integrator receiving and integrating said electrical signals and being connected to said first means for terminating said dispensing when said sounds indicate a predetermined volume of ice has been dispensed.

4. An ice system for a soft drink dispenser, comprising:

an ice bin;

first means for dispensing pieces of ice from said bin into a receptacle; and second means for measuring an amount of ice received by said receptacle and terminating said dispensing when said amount exceeds a set level, wherein said second means counts a number of said pieces of ice dispensed into said receptacle by sensing sounds made by said pieces of ice as they are received by said receptacle and correlating said sounds to particular volumes of said pieces of ice, said second means comprising a microphone in juxtaposition to said receptacle, generating electrical signals corresponding to said sounds, an analog to digital converter digitizing said electrical signals, and a counter counting said digitized signals.

5. The ice system according to claim 4, wherein said first means comprises an auger in communication with said ice bin and driven by a motor.

6. An ice dispenser for a soft drink system, comprising:

an ice bin containing pieces of ice;

first means for dispensing said pieces of ice into a receptacle; and second means for sensing sounds made by said pieces of ice dispensed into said receptacle, converting said sounds into electrical signals, and determining a volume of ice so dispensed as a function of said sounds, said second means being connected to said first means for terminating said dispensing when said sounds indicate a predetermined volume of ice has been dispensed, said second means further comprising an analog to digital converter digitizing said electrical signals and a counter counting said digitized electrical signals.

* * * * *